United States Patent [19]

Klitz

[11] 3,978,998

[45] Sept. 7, 1976

[54] FAST HOIST CONTROL SYSTEM

[75] Inventor: Ronald J. Klitz, Mosinec, Wis.

[73] Assignee: J. I. Case Company, Racine, Wis.

[22] Filed: May 16, 1975

[21] Appl. No.: 578,112

[52] U.S. Cl. ..... 214/132; 91/411 R; 214/138 R

[51] Int. Cl.[2] ..... E02F 3/00

[58] Field of Search ..... 214/138 R, 132, 140, 214/762, 763, 764; 91/411, 412, 461

[56] References Cited

UNITED STATES PATENTS

| | | | |
|---|---|---|---|
| 2,979,908 | 4/1961 | Shook | 214/140 |
| 3,578,787 | 5/1971 | Brickett et al. | 214/138 R |
| 3,641,876 | 2/1972 | Wienke | 91/461 |

*Primary Examiner*—L. J. Paperner
*Assistant Examiner*—Ross Weaver
*Attorney, Agent, or Firm*—Dressler, Goldsmith, Clement, Gordon & Shore, Ltd.

[57] ABSTRACT

A hydraulic control system for operating various hydraulic motor means used in operation of a vehicle and earthworking implement in which hydraulic motor means is normally automatically disabled upon operation of a second hydraulic motor means but in which the automatic disabling function can be bypassed.

5 Claims, 2 Drawing Figures

FAST HOIST CONTROL SYSTEM

BACKGROUND OF THE INVENTION

This invention relates to a hydraulic circuit for supplying hydraulic fluid to a plurality of hydraulic drive motors found in heavy equipment, such as excavators, backhoes and the like.

In recent years, the use of hydraulic drive systems for controlling the various functions in heavy equipment, for example, vehicles having earthworking implements, such as excavators, has become more common. For example, quite recently, completely hydraulic systems have been developed for use with heavy duty vehicles such as excavators.

In such systems, the actuation of control valves that control the flow of fluid to the various drive motors is accomplished by hydraulic fluid. One example of such a system incorporates a main hydraulic circuit that includes one or more main pumps and a plurality of hydraulically actuated valves that control the flow of fluid between the pumps, a reservoir and hydraulic motors associated therewith. Typically, the valves are self-centering and are opened by a control circuit that is capable of supplying small amounts of fluid under pressure from a source to opposite ends of the valves for actuating the valves. The fluid flow in the control circuit is controlled by manually and electrically operated valves and acts as a "pilot system" for actuating the main control valves.

Such a system has a number of advantages, the primary one being that the function that is being performed can be accurately controlled. For example, utilizing the "pilot system" for actuating the main valves gives the operator the ability to introduce very small amounts of fluid to the hydraulic motors.

While such systems have found a remarkable degree of success, there do exist certain limitations capable of being eliminated. For example, in one embodiment of such a system, parallel hydraulic circuits are utilized to rotate the cab or upper structure relative to the vehicle and to raise and lower the main lift boom. The hydraulic circuit utilized for rotating the upper structure is also utilized to supplement the other circuit to hoist or lift the boom at a greater than normal rate of speed.

In such a configuration, since the pumps utilized in the system have only a limited capability, it has been conventional to automatically disable or deactivate the supplemental fast hoist system capability when rotation of the upper structure is initiated. While usually desirable, this automatic circuit deactivation sometimes is inconvenient and unnecessary, and, therefore, it would be desirable to be able to override automatic deactivation in order to allow simultaneous rotation of the upper structure or cab and rapid lifting or hoisting of the main boom.

SUMMARY OF THE INVENTION

According to the present invention, there is provided in a hydraulic drive system for controlling the various functions in heavy equipment vehicles such as excavators, a control circuit, typically electrically operated, which is capable of selectively allowing rotation or swinging of the upper structure or cab and simultaneous rapid hoisting of the main boom.

More specifically, a hydraulically actuated supplemental or fast hoist valve connected to the lift hydraulic motor means is selectively operated by a solenoid actuated valve connected in an electric circuit which includes condition responsive switches connected in the swing or rotation hydraulic control circuit. In normal operation, the condition responsive switches respond to initiation of rotation or swinging of the upper structure or cab to automatically deactivate the solenoid operated valve. However, in accordance with the present invention, the operator may selectively bypass the deactivating system to simultaneously operate the hydraulic circuit for rotating the cab or upper structure as well as the hydraulic circuits for raising the main boom at a higher than normal rate of speed.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

DETAILED DESCRIPTION

Figure 1:
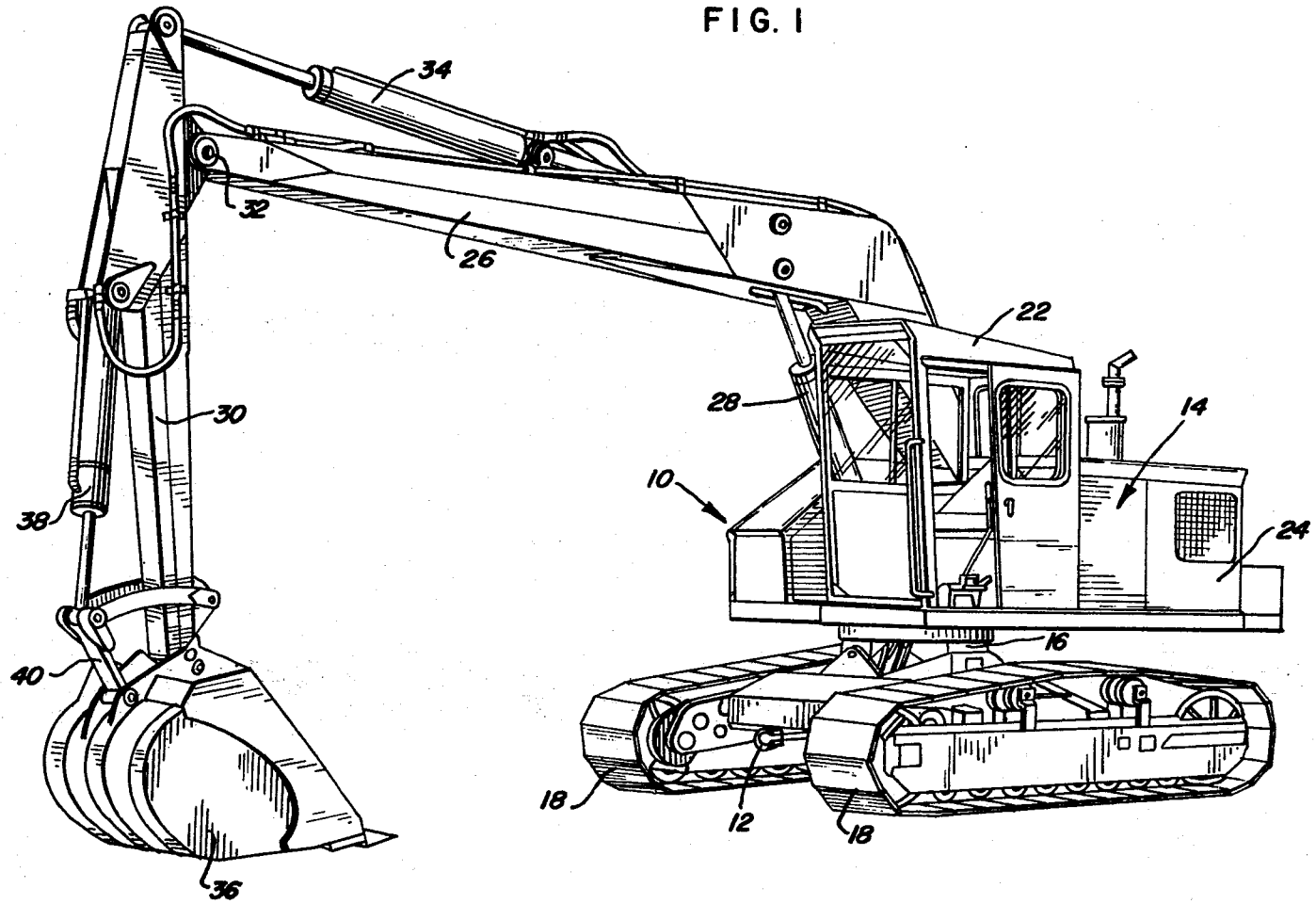
FIG. 1 is a pictorial view of one type of shovel-type excavator wherein the hydraulic circuit forming the substance of the present invention is particularly useful.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Referring now to FIG. 1, there is shown a shovel-type excavator, generally indicated by reference numeral 10, having an undercarriage 12 and an upper structure 14. The upper structure is pivotally carried about a vertical axis on a turntable 16. Swing hydraulic motor means 17 (see FIG. 2) operated by pressurized hydraulic fluid is provided for pivoting or swinging the upper structure 14 relative to undercarriage 12.

Undercarriage 12 is supported by a pair of ground engaging members or tracks 18 which are driven by separate hydraulically operated positive displacement gear motors (not shown), also driven by pressurized fluid. Upper structure 14 includes a cab 22 for the operator and a propulsion unit 24, such as an engine, for driving pumps, as will be described later.

A main lift boom 26 is pivotally mounted about a horizontal pivot axis (not shown) on upper structure 14 and is pivoted by hydraulic hoist or lift motor means 28 illustrated as a lift or hoist cylinder and piston rod assembly interposed between upper structure 14 and boom 26.

A dipper stick 30 is pivotally connected to the outer end of boom 26 by pivot pin 32 which is substantially parallel to the axis or pivotal connection of boom 26 to upper structure 14. A second hydraulic motor means 34 is interposed between boom 26 and a free end portion of dipper stick 30. Again, hydraulic motor means 34 is illustrated as a cylinder and piston rod assembly which acts as a crowd cylinder to pivot the dipper stick 30 relative to boom 26.

A bucket 36 is pivotally mounted on the outer end of dipper stick 30 for movement about a horizontal axis by a third hydraulic motor means 38. Third hydraulic motor means 38 again consists of a cylinder and piston rod assembly which has one end connected to dipper stick 30 and the opposite end connected to bucket 36 through a linkage 40.

While only single hoist, crowd and bucket hydraulic motors or cylinders 28, 34 and 38, respectively are shown in FIG. 1, it should be understood that more than one of each of such hydraulic motors may be incorporated in excavators of the type shown in FIG. 1.

In a large excavator of this type, it is customary to provide two separate main hydraulic pumps which are driven by the engine or power plant of the vehicle and the respective pumps are connected to the respective hydraulic motor means through conduits having pilot operated control valves therein. Since the present invention relates only to a small portion of the entire hydraulic control circuit for the vehicle, only a selected portion of the circuit has been illustrated in FIG. 2.

Figure 2:
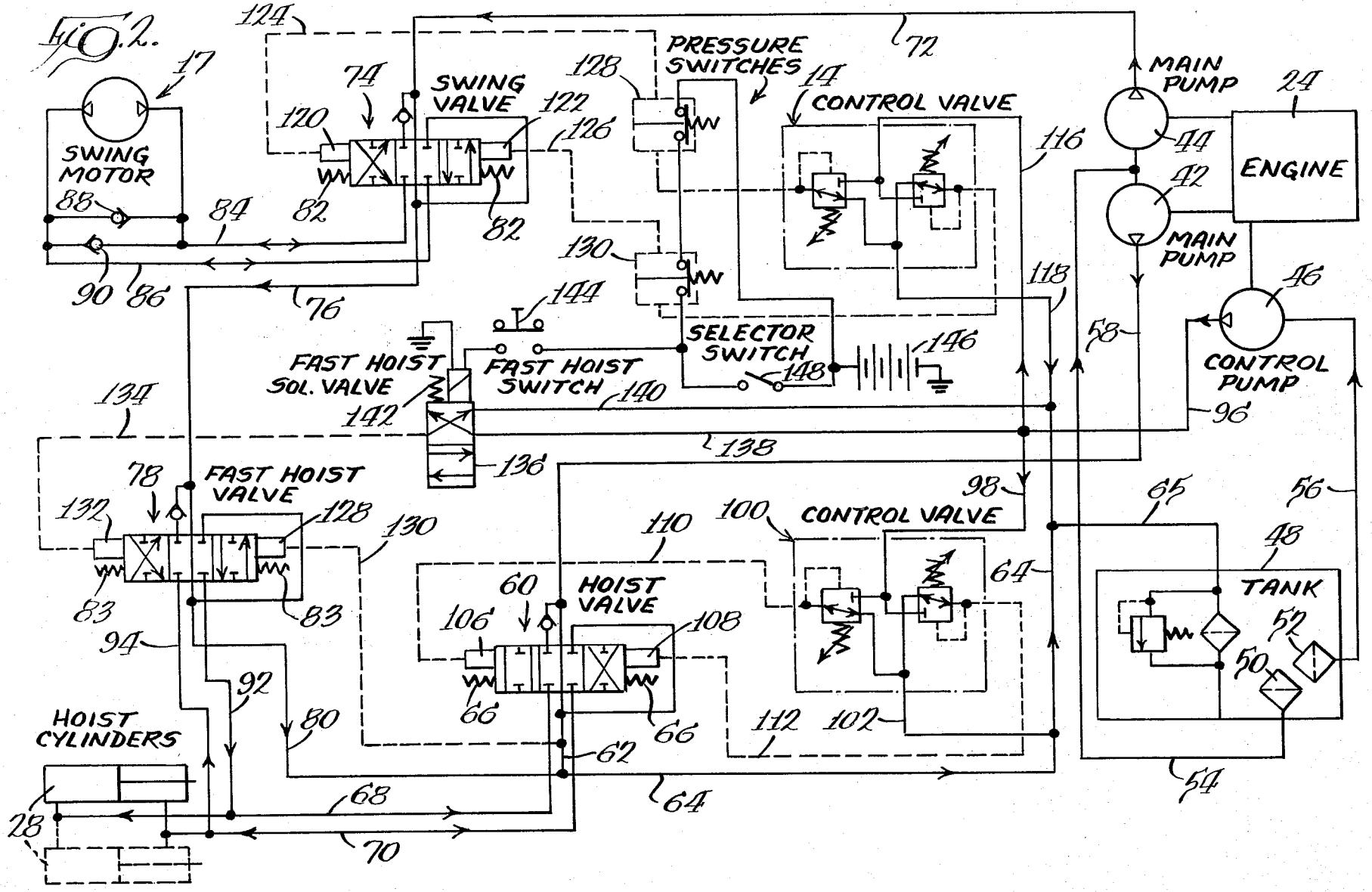
FIG. 2 is a schematic diagram of a hydraulic system in accordance with the present invention.

FIG. 2 shows engine 24 driving a pair of main pumps 42, 44 and a control pump 46, all of which draw fluid from a reservoir or tank 48. Suitable filters 50, 52 may be placed at the inlet of a pair of conduits 54, 56, conduit 54 leading from the reservoir 48 to the main pumps 42, 44 and conduit 56 leading from the reservoir 48 to the control pump 46.

The first main pump means 42 delivers fluid under pressure from the reservoir 48 through a first main supply conduit 58 to a fluid actuated hoist valve 60 which is connected to the reservoir through main return conduits 62, 64, 65. Hoist valve means 60 consists of a three position valve which is normally biased to the illustrated center, closed position by a pair of springs 66 respectively cooperating with opposite ends of the control valve spool forming part of the hoist valve means 60.

Hoist valve means 60 is also connected through a pair of hoist motor conduits 68, 70 to opposite ends of the one or more cylinders which form part of the hydraulic hoist motor means 28.

The second main pump 44 delivers fluid under pressure from the reservoir 48 through a second main supply conduit 72 to fluid actuated swing valve means 74 which is connected through an intermediate conduit 76 to fluid actuated fast hoist valve means 78 which, in turn, is connected to the reservoir through return conduits 64, 65, 80.

The swing valve means 74 and the fast hoist valve means consist of three position valves which are normally biased to the illustrated center, closed position by a pair of springs 82, 83 respectively cooperating with opposite ends of the control valve spools forming part of the swing valve means 74 and the fast hoist valve means 78, respectively.

The swing valve means 74 is also connected to opposite ends of the swing motor 17 through a pair of swing motor conduits 84, 86. A pair of oppositely disposed safety check valves 88, 90 are connected across the swing motor conduits 84, 86.

The fast hoist valve means 78 is also connected through a pair of secondary hoist conduits 92, 94 to opposite ends of the hoist cylinders which form part of the hydraulic motor means 28. The hoist hydraulic motor means 28 is the motor which raises and lowers or hoists the entire boom 26 as well as the dipper stick assembly supported thereon.

Operation of the swing motor means 17 and the hoist hydraulic motor means 28 is controlled by actuation of the swing control valve means 74, the hoist control valve means 60 and the fast hoist control valve means 78 through control circuits which incorporate the control pump 46.

In the first control circuit, the control pump 46 is connected through control conduits 96, 98 to first manually operated hoist control valve means 100 which is connected to the reservoir through return control conduits 64, 65, 102. The hoist control valve means 100 is also connected to opposite ends 106, 108 of the control valve spool of the hoist valve means 60 through hoist valve control conduits 110, 112. The first control valve 100 is manually actuated, typically through either a hand operated control lever or a foot lever and is capable of being manipulated to supply fluid under pressure from the control pump 46 through either of the hoist valve control conduits 110, 112.

In the second control circuit, the control pump 46 is connected to second manually operated swing control valve means 114 through control conduits 96, 116. The swing control valve means 114 is connected to the reservoir 48 through return conduits 65, 118. In addition, the swing control valve means 114 is connected to opposite ends 120, 122 of the control valve spool of the swing valve means 74 through a pair of swing valve control conduits 124, 126. A pair of pressure responsive switches 128, 130 are provided in the swing valve control conduits 124, 126, respectively the use and function of which being described in more detail below.

The swing control valve means 114 is actuated manually, either by way of a hand operated control lever or a foot lever, capable of being manipulated to supply fluid under pressure from the control pump 46 through either of the swing valve control conduits 124, 126. Since a control valve such as valves 100, 114 are commercially available, no details thereof appear to be necessary. However, it should be noted that such control valves are capable of accurately controlling small amounts of flow from the control pump to opposite ends of the valves to accurately control the flow of fluid to and from the respective motor means.

One end 128 of the control spool for the fast hoist control valve means 78 is connected to the reservoir 48 through return conduits 62, 64, 65, 130. The other end 132 of the control spool for the fast hoist control valve 78 is connected through conduit 134 and fast hoist control solenoid valve means 136, either to the control pump 46 through control conduits 96, 138 or to the reservoir 48 through return conduits 65, 118, 140.

The fast hoist solenoid valve 136 is normally biased to the position illustrated in the drawing by a bias spring 142 so that the end 132 of the control spool of the fast hoist valve 78 is normally connected to the reservoir 48. The fast hoist solenoid valve 136 is actuated to connect the end 132 of the control spool of the fast hoist valve 78 to the control pump 46 upon closure of the manually operable fast hoist control switch 144 connected to a source of electric energy, such as the battery 146 forming a part of the vehicle or excavator 10, through either a normally open manually operable selector switch 148 which, for example, may be a toggle switch, or the pressure switches 128, 130, in parallel with the selector switch 148.

Since the hydraulic circuit shown in FIG. 2 includes only two main pumps 42, 44, the swing valve 74 is connected in series with the fast hoist valve 78. As a result, the swing valve 74 and the fast hoist valve 78 should be operated simultaneously only if the sum of the pressure requirements for each function do not exceed the capacity of the main pump 44. In normal operation, one of the two pressure switches 128, 130 connected in the control circuit for the swing valve 74 open when the swing valve control valve 114 is operated to open the electrical circuit to the fast hoist solenoid valve 136 precluding actuation of the solenoid valve and maintaining or returning it to the position illustrated in FIG. 2, and causing the fast hoist valve 78 to shift to the illustrated neutral position, thereby insuring adequate power for the swing function.

There are circumstances and situations, however, when the swing valve 74 and the fast hoist valve 78 can be operated simultaneously. In these circumstances, the fast hoist selector switch 148 is closed to bypass the pressure switches 128, 130, thereby permitting simultaneous operation of the swing valve 74 and the fast hoist valve 78. This gives the operator the option to eliminate the automatic deactuation of the fast hoist valve depending upon the particular requirements of the operations in progress.

During normal operation of the excavator, the main pumps 42, 44 and the control pump 46 are being driven by the engine to provide the main supply of fluid and a control supply of fluid for operating the various fluid operated devices. For example, in the portion of the circuit illustrated, control pump 46 supplies fluid under pressure to both of the control valves 100, 114 and to the fast hoist solenoid valve 136. The hoist valve 60 is actuated by manipulation of a manual control lever associated with control valve 100 to selectively control the flow of fluid to and from hydraulic motor means 28. Closure of the fast hoist switch 144 energizes the fast hoist solenoid valve 136 to connect the output of the control pump 46 to the fast hoist valve 78 thereby supplementing the flow of fluid to the hydraulic motor means 28.

As explained above, when the operator utilizes the swing motor 17, operation of the swing control valve 114 will apply pressure to one or the other of the two pressure switches 128, 130 thereby opening the electric fast hoist control circuit to deenergize the fast hoist solenoid valve 136. This occurs automatically unless the operator closes the selector switch 148 to effectively bypass the pressure switches.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. In a vehicle having an upper structure supported thereon and rotatable with respect thereto by hydraulic swing motor means and an earth working implement supported on said upper structure and movable with respect thereto by hydraulic lift motor means, a control system comprising:

first main hydraulic circuit means including said lift motor means, a reservoir, main pump means for supplying pressurized fluid from said reservoir to said lift motor means, and first fluid actuated lift valve means actuatable to control flow of pressurized fluid to and from said lift motor means;

second main hydraulic circuit means including said swing motor means, said lift motor means, said reservoir, said main pump means for supplying pressurized fluid from said reservoir to said swing motor means and to said lift motor means, fluid actuated swing valve means actuatable to control flow of pressurized fluid to and from said swing motor means, and second fluid actuated lift valve means actuatable to control flow of pressurized fluid to and from said lift motor means;

first control hydraulic circuit means including said first lift valve means, said reservoir, control pump means for supplying fluid under pressure from said reservoir to said first lift valve means, and manually operated lift control valve means for controlling flow of fluid to and from said first lift valve means to control actuation thereof;

second control hydraulic circuit means including said swing valve means, said reservoir, said control pump means for supplying fluid under pressure from said reservoir to said swing valve means, manually operated swing control valve means for controlling flow of fluid to and from said swing valve means to control actuation thereof, and normally closed switch means opening in response to a preselected condition in said second control hydraulic circuit means;

third control hydraulic circuit means including said second lift valve means, said reservoir, said control pump means for supplying fluid under pressure from said reservoir to said second lift valve means, and second lift control valve means for controlling the flow of fluid to and from said second lift valve means to control actuation thereof; and fourth control circuit means including said normally closed condition responsive switch means selectively operable switch means connected to said condition responsive switch means for selectively actuating said second lift control valve means and thereby said second lift valve means when said condition responsive switch means is closed, and means selectively operable to bypass said condition responsive switch means, whereby said selectively operable switch means selectively actuates said second lift control valve means independently of said condition responsive switch means.

2. A control system as claimed in claim 1 wherein:

said second lift control valve means comprises a solenoid operated valve means; and said fourth control circuit means comprises an electric control circuit.

3. A control system as claimed in claim 2 wherein said electric control circuit includes:

a source of electrical energy, said selectively operable switch means connected in series with said condition responsive switch means, said source and said solenoid operated valve means and said selectively operable bypass means connected in parallel with said condition responsive switch means.

4. A control system as claimed in claim 3 wherein:

said bypass means comprises manually operable switch means.

5. A control system as claimed in claim 4 wherein:

said condition responsive switch means comprises pressure responsive switch means opening in response to operation of said manually operated swing control valve means to supply fluid under pressure to said swing valve means.

* * * * *